US005257042A

United States Patent [19]

Buhler

[11] Patent Number: 5,257,042

[45] Date of Patent: Oct. 26, 1993

[54] THERMAL INK JET TRANSDUCER PROTECTION

[75] Inventor: Steven A. Buhler, Redondo Beach, Calif.

[73] Assignee: Xerox Corporation, Stamford, Conn.

[21] Appl. No.: 727,493

[22] Filed: Jul. 9, 1991

[51] Int. Cl.[5] ..... B41J 2/05

[52] U.S. Cl. ..... 346/140 R

[58] Field of Search ..... 346/140 R

[56] References Cited

U.S. PATENT DOCUMENTS

| | | | |
|---|---|---|---|
| Re. 32,572 | 1/1988 | Hawkins et al. | 156/626 |
| 4,370,668 | 1/1983 | Hara et al. | 346/140 R |
| 4,532,530 | 7/1985 | Hawkins | 346/140 R |
| 4,719,477 | 1/1988 | Hess | 346/140 R |
| 4,774,530 | 9/1988 | Hawkins | 346/140 R |
| 4,931,813 | 5/1990 | Pan et al. | 346/140 R |
| 4,935,752 | 6/1990 | Hawkins | 346/140 R |
| 4,947,192 | 8/1990 | Hawkins et al. | 346/140 R |
| 4,947,193 | 8/1990 | Deshpande | 346/140 R |
| 4,951,063 | 8/1990 | Hawkins et al. | 346/1.1 |
| 4,956.653 | 9/1990 | Braun | 346/140 R |

*Primary Examiner*—Benjamin R. Fuller
*Assistant Examiner*—Alrick Bobb
*Attorney, Agent, or Firm*—Daniel J. O'Neill

[57] ABSTRACT

The present invention provides an ink jet printhead that is provided a bias voltage and that includes at least one ink channel, a heating element, and an interconnect. The ink channel has an open end that serves as a nozzle, and the heating element is positioned in the channel for ejecting ink droplets from the nozzle by selective application of current pulses along the interconnect to the heating element. The printhead further includes a conductive protective region that is positioned adjacent the heating element and that has a portion thereof exposed to the ink channel for protecting the heating element from ink. Positioned between the conductive protective region and the heating element is a dielectric region for insulating the heating element from the conductive protective region. The printhead also includes a bus for connecting the bias voltage to the conductive protective region.

7 Claims, 4 Drawing Sheets

THERMAL INK JET TRANSDUCER PROTECTION

This invention relates to thermal ink jet printheads, and more particularly to thermal ink jet printheads constructed to resist corrosion of heater elements.

BACKGROUND AND INFORMATION DISCLOSURE STATEMENT

Thermal ink jet printers are well known in the prior art as exemplified by U.S. Pat. No. Re. 32,572 issued to Hawkins et al. In the system disclosed in this patent, a thermal printhead comprises one or more ink-filled channels communicating with a relatively small ink supply chamber at one end and having an opening at the opposite end, referred to as a nozzle. A plurality of heating resistors are located in the channels at a predetermined distance from the nozzle. The heating resistors are individually addressed with a current pulse to momentarily vaporize the ink and form a bubble which expels an ink droplet. Typically, the ink is water-based, and the bubble that forms consists of water vapor. As the bubble grows, the ink bulges from the nozzle and is contained by the surface tension of the ink as a meniscus. As the bubble begins to collapse, the ink still in the channel between the nozzle and bubble starts to move towards the collapsing bubble, causing a volumetric contraction of the ink at the nozzle and resulting in the separating of the bulging ink as a droplet. The acceleration of the ink out of the nozzle while the bubble is growing provides the momentum and velocity of the droplet in a substantially straight line direction towards a recording medium, such as paper.

In the channels, the heating resistors are subject to wear from corrosive ink as well as from mechanical shock produced by collapsing bubbles and thermal fatigue. In particular, the temperature of the ink adjacent an active heating resistor reaches at least 300 degrees centigrade, which is the temperature at which bubble nucleation occurs. Since the expected lifetime for commercial heating resistors is at least 200 million firings, measures are taken to protect the heating resistors. One measure is to construct the heating resistors to withstand the wear. For example, U.S. Pat. No. 4,931,813 to Pan et al. discloses forming the heating resistor from a relatively thick layer of unpassivated resistive material, such as TaAl. While this approach is generally adequate, it has the disadvantage that direct exposure of the heating resistors to the ink and cavitation forces can cause wear of and changes to the heating resistors. These effects can result in nonuniform print quality.

Another measure is to cover the heating resistors with protective layers, thus sparing the resistors from direct contact with the ink. For example, U.S. Pat. No. Re. 32,572 issued to Hawkins et al, U.S. Pat. No. 4,774,530 to Hawkins and U.S. Pat. No. 4,935,752 to Hawkins disclose covering heating resistors and associated electrodes with a passivation layer of silicon dioxide, silicon nitride, or both. In addition, a tantalum layer may be deposited on the passivation layer above the heating resistors for additional protection against cavitation forces. Similarly, U.S. Pat. No. 4,951,063 to Hawkins et al. discloses covering heating resistors with a high temperature deposited plasma or pyrolytic silicon nitride layer followed by a tantalum layer. Tantalum layers are strong and resist corrosion.

While the tantalum layer generally provides adequate protection, it is subject to erosion. One mechanism for erosion is hydrogen embrittlement, a process whereby a metal, such as tantalum, absorbs hydrogen and becomes brittle. Brittle tantalum can be easily fractured, particularly since the tantalum layer is subject to cavitation forces when a bubble collapses. Hydrogen can be absorbed into many materials if a voltage bias is present. Moreover, even without a bias voltage, tantalum can absorb hydrogen if the temperature of the tantalum is sufficiently high. For example, absorption occurs without bias at the operating temperature of a typical thermal ink jet. In a typical thermal ink jet, the temperature on the tantalum layer surface reaches at least 300 degrees centigrade, the temperature at which bubble nucleation occurs. After nucleation, the temperature exceeds the nucleation temperature because the heating resistor is still producing heat and the newly formed bubble insulates the heating resistor from the heat-conducting ink. The temperature can reach 450 degrees centigrade.

The source of the hydrogen is the hydronium ion (the hydrated proton, $H_3O^+$). The hydronium ion is always present in the water in the water-based ink. Aside from hydronium ions normally present in water, the ink typically contains a greater concentration of hydronium ions because it is salted and acidic. The ink is salted to make it conductive to aid in sensing the amount, or absence, of ink in a printhead. Moreover, the ink is made acidic to avoid the etching of tantalum and of silicon that results from alkaline water.

Another mechanism for erosion of the tantalum layer is electrochemical reaction between the tantalum and the ink. The reaction is increased by voltage transients or spikes that pass through the tantalum layer during the rise and fall of a current pulse through the heating resistor associated with that particular tantalum layer. The voltage spikes are caused by capacitive coupling between the tantalum layer and its heating resistor. Capacitive coupling occurs because the tantalum region is separated from the heating resistor by an insulating dielectric layer, forming a capacitor between the tantalum layer and its heating resistor.

Significant capacitive coupling occurs unless the RC time constant of the tantalum layer and surrounding environment is much less than the rise and fall times of the current pulses. Typically, the current pulses have a period of 5 microseconds, and correspondingly short rise and fall times (e.g., 10 to 50 nanoseconds). The rise and fall times are particularly quick for printheads having the current pulse driver transistors located on the same integrated circuit substrate as the heating resistors. (Placing drive transistors and resistors on the same substrate is popular because it allows multiplex addressing of the drive transistors, which reduces the number of leads connected to the substrate. Placing drive transistors on the same substrate, however, reduces the capacitive load to the driver transistors, which also decreases the rise and fall times.) For calculating the RC time constant, typically there is a capacitance of about 3 picofarads between a tantalum layer and its associated resistor. The resistive component of the RC time constant is mainly the resistance from the tantalum layer to ground through the conductive ink contacting the tantalum layer. The ink resistance depends largely on the salt content of the ink. Ink resistances range from 1000 ohms to 50,000 ohms, with 10,000 ohms being a typical value. For the typical ink resistance of 10,000 ohms, the RC time constant is about 30 nanoseconds. For this case the magnitude of the voltage spikes approaches its theoretical maximum of half the voltage across the heating resistor.

SUMMARY OF THE INVENTION

According the present invention, an ink jet printhead is supplied a bias voltage and has at least one ink channel, a heating element, and an interconnect. The ink channel has an open end that serves as a nozzle, and the heating element is positioned in the channel for ejecting ink droplets from the nozzle by selective application of current pulses along the interconnect to the heating element. The printhead further includes a conductive protective region that is positioned adjacent the heating element and that has a portion thereof exposed to the ink channel for protecting the heating element from ink. Positioned between the conductive protective region and the heating element is a dielectric region for insulating the heating element from the conductive protective region. The printhead also includes means for connecting the bias voltage to the conductive protective region.

In other aspects of the present invention, the protective region includes a layer of tantalum, and the means for connecting the bias voltage to the conductive protective region includes an aluminum interconnect for providing a low resistance connection between the bias voltage and the conductive protective region.

Other features of the present invention will become apparent as the following description proceeds and upon reference to the drawings, in which:

DETAILED DESCRIPTION OF THE PREFERRED EMBODIMENT

While the present invention will hereinafter be described in connection with a preferred embodiment and method of manufacture, it will be understood that it is not intended to limit the invention to that embodiment. On the contrary, it is intended to cover all alternatives, modifications, and equivalents as may be included within the spirit and scope of the invention as defined by the appended claims.

Figure 1:
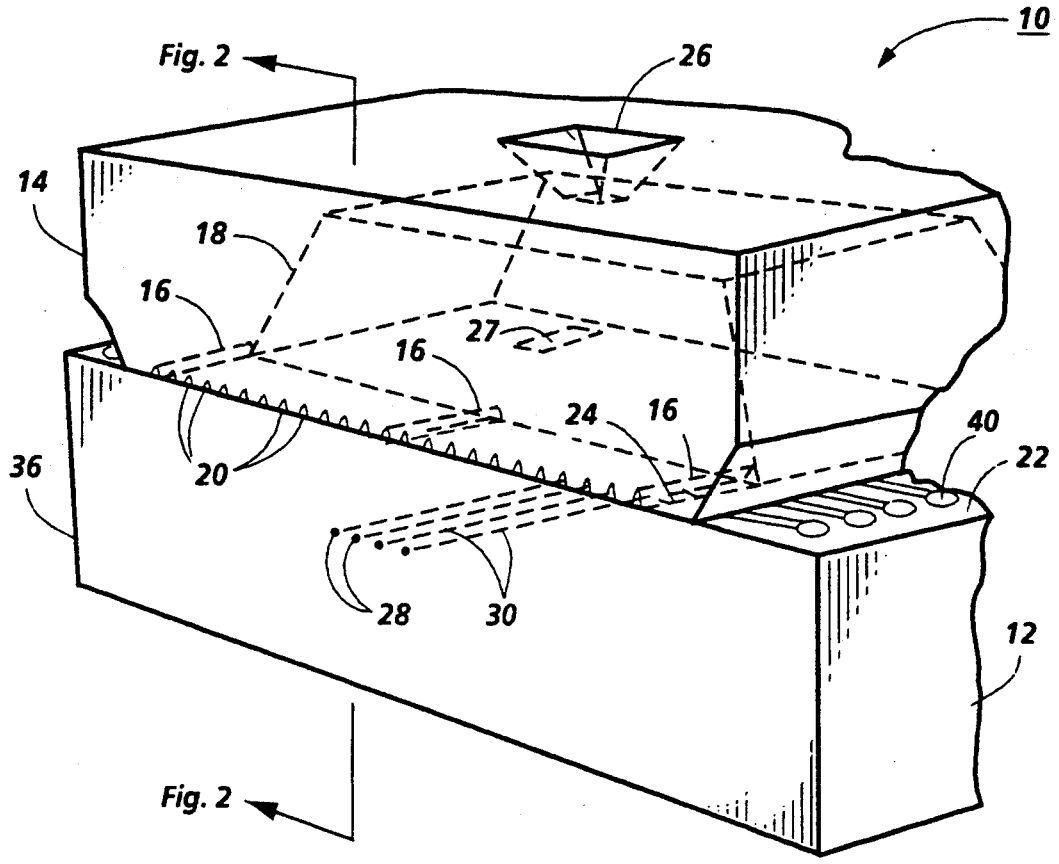
FIG. 1 is an enlarged schematic isometric view of a printhead embodying the invention.
Figure 2:
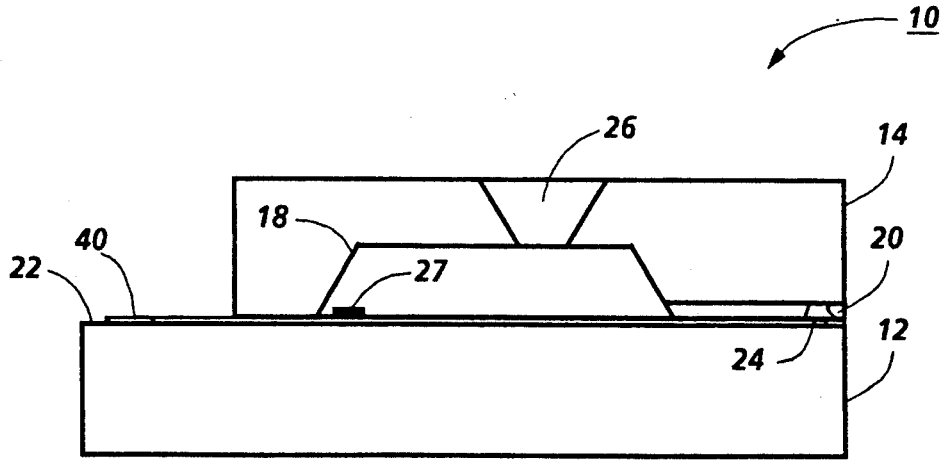
FIG. 2 is an enlarged cross sectional view of the printhead of FIG. 1.

Referring now to FIGS. 1 and 2, there is shown a preferred embodiment of a side shooter thermal ink jet (TIJ) printhead 10 embodying the present invention. Printhead 10 comprises an electrically insulated substrate heater board 12 permanently attached to a structure board 14. Structure board 14 includes parallel triangular cross-sectional grooves 16 which extend from an ink reservior 18 in one direction and penetrate through front edge of printhead 10. Heater board 12 is aligned and bonded to the surface of structure board 14 with grooves 16 so that ink channels 20 are formed by grooves 16 and the surface 22 of the heater board 12, and so that a respective one of the plurality of ink channels 20 has positioned in it a respective one of the plurality of heating resistors 24. Ink reservior 18 can be filled with ink through fill hole 26. The presence of ink (not shown) in reservoir 18 is detected by a sensor (not shown) that includes grounded sensor contact 27, positioned on a portion of heater board 12 that forms the base of reservoir 18.

Figure 4:
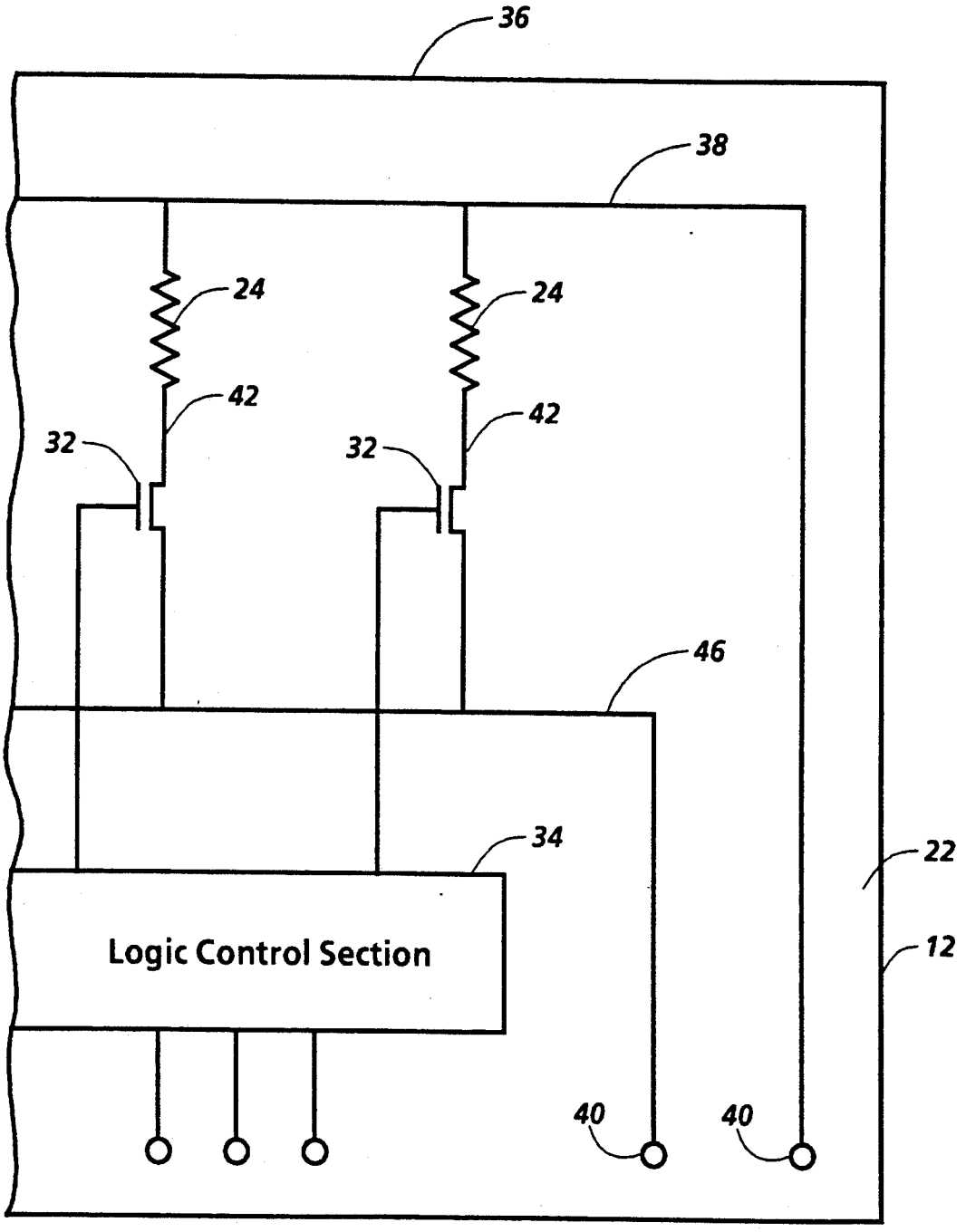
FIG. 4 is a partial schematic top view of the printhead of FIG. 1, showing the power buses, heating resistors, tantalum protective regions, drive transistors and control logic.

Referring now to FIGS. 1 and 4, ink drops 28 are ejected from channels 20 along paths 30 in response to current pulses sent to heating resistors 24 by drive transistors 32. Drive transistors 32 are controlled by logic control section 34. Heating resistors 24, drive transistors 32 and logic control section 34 are all formed on surface 22 of heater board 12. A preferred technique for forming drive transistors 32 is by monolithic integration of MOS transistor switches onto the same silicon substrate containing heating resistors 24. This technique is described in U.S. Pat. No. 4,947,192 issued to Hawkins et al., which is incorporated by reference. In FIG. 1, while only 24 ink channels 20 are shown for illustrative purposes, it is understood that many more channels 20 may be formed within a single printhead 10. For page width applications, for example, printhead 10 may include 200 channels 20.

Figure 3:
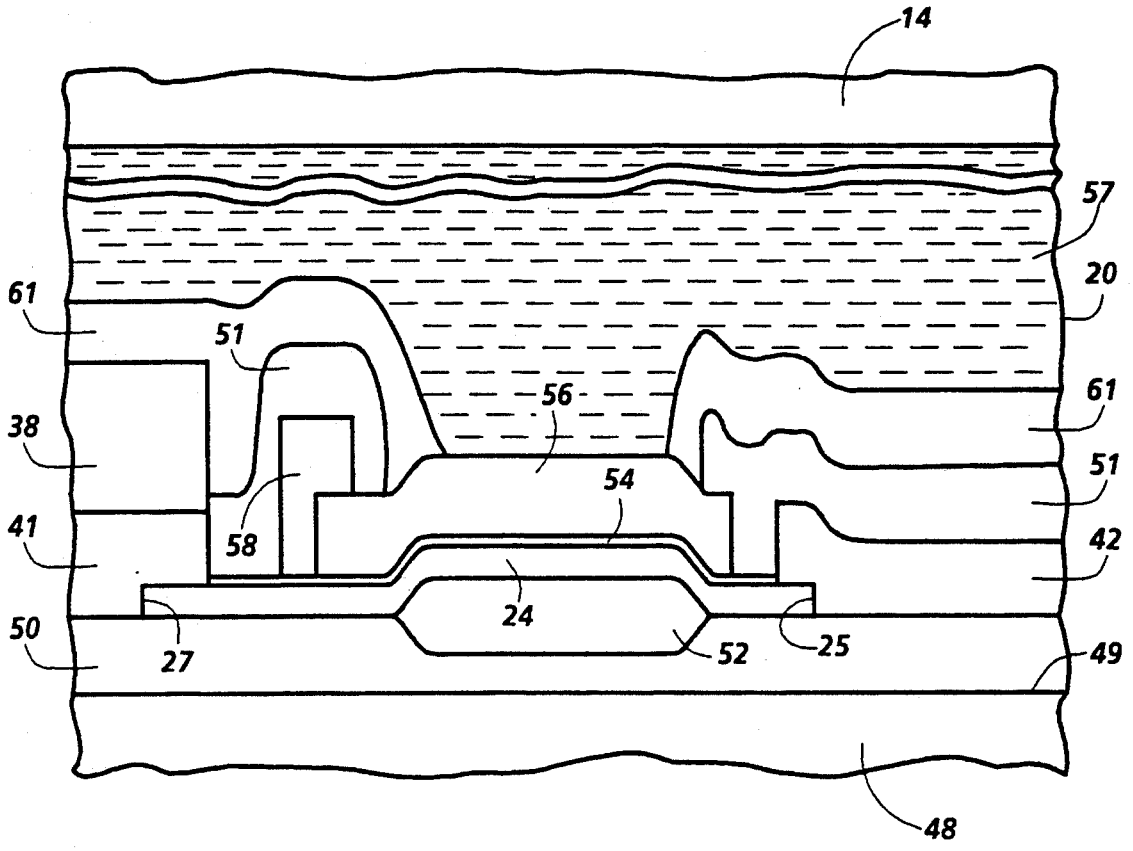
FIG. 3 is an enlarged cross sectional view of the printhead of FIG. 1.

Referring now to FIGS. 3 and 4, heating resistors 24 are positioned in close proximity to (about 120 micrometers away from) the front face 36 of printhead 10. An aluminum power bus 38 extends in the space between front face 36 and heating resistors 24, and connects to heating resistors 24 by means of interconnects 41 that are positioned between power bus 38 and heating resistors 24. Power bus 38 terminates at either end in terminals 40. Via terminals 40, power bus 38 connects to an external power supply (not shown). At terminals 40, the external power supply typically provides 40 Volts. Connecting opposite ends of bus 38 to the power supply reduces the voltage drop across along the length of bus caused by parasitic resistance. Heating resistors 24 are connected to the drains (not shown) of their respective drive transistors 32 by aluminum interconnects 42. Interconnects 42 contact their respective heating resistors 24 at the side 25 of heating resistors 24 opposite power bus 38. The sources (not shown) of drive transistors 32 connect to a common bus 46, and the gates connect to logic control section 34. Common bus 46 terminates at either end in terminals 40, via which common bus 46 connects to an external ground (not shown).

Each heating resistor 24 is covered by a tantalum region 56, and between each tantalum region 56 and its heating resistor 24 is a dielectric region 54. A passivation layer 61 covers most of the surface 22 of heater board 12. Left uncovered by passivation layer 61 are terminals 40, and a portion of each tantalum region 56 to allow ink 57 to contact the tantalum regions 56. The tantalum regions 56 and dielectric regions 54 protect their associated heating resistors 24 from cavitation damage and from the corrosive effects of ink 57. Moreover, dielectric regions 54 prevent their associated tantalum regions 56, which are conductive, from shorting their associated heating resistors 24. Dielectric regions 54 are about 0.5 micrometers thick, and are constructed of silicon dioxide, silicon nitride, or layers of both materials.

Ink 57 is particularly corrosive because it is salted to make it conductive. Ink 57 needs to be conductive for proper operation of the standard types of ink sensors (not shown). The ink sensor senses the presence or absence of ink in reservoir 18. The ink sensor includes a sensor contact 27 (shown in FIGS. 1 and 2), positioned on heater board 12 within reservoir 18. Sensor contact 27 is connected to an external ground (not shown).

Figure 5:
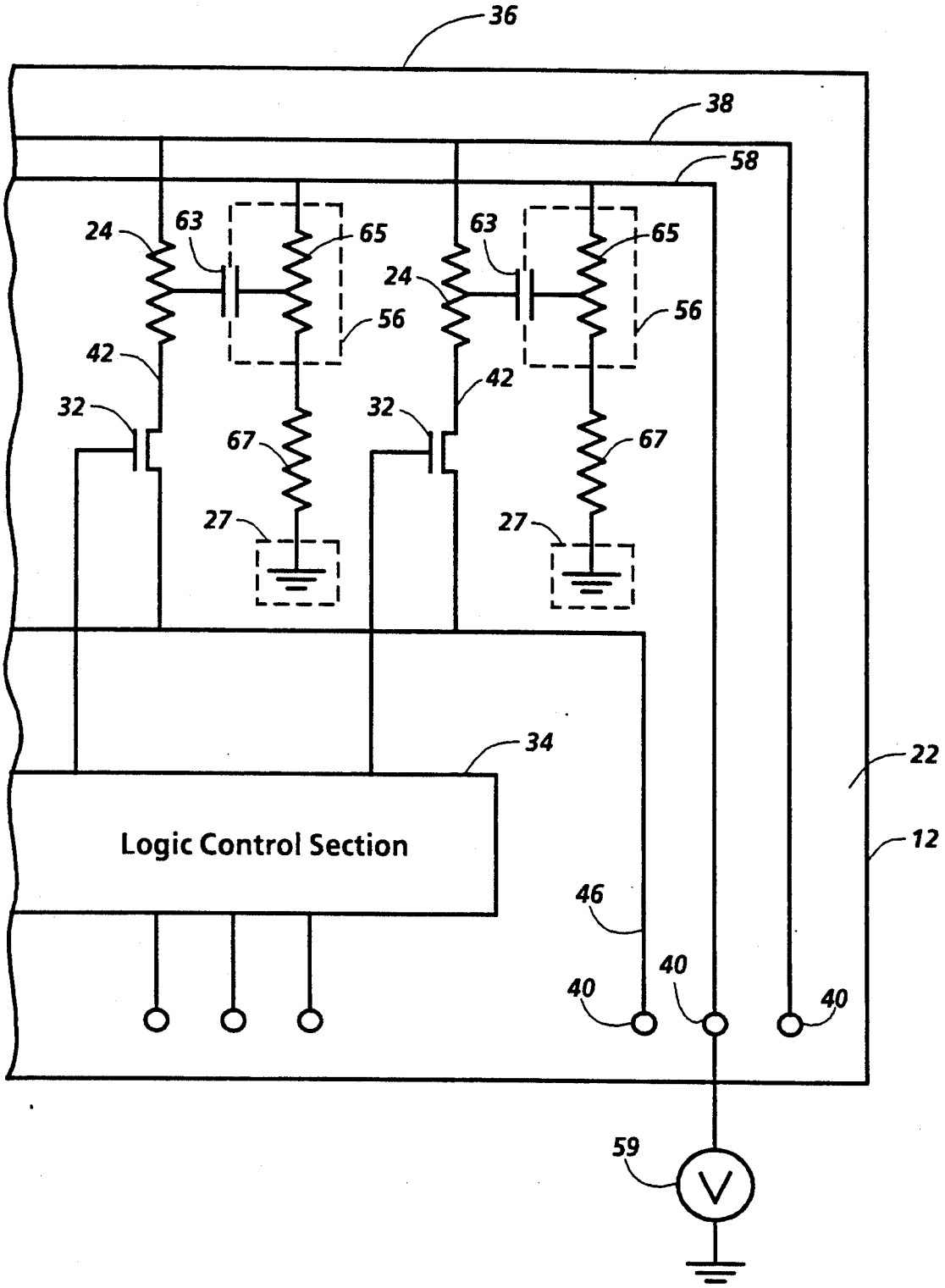
FIG. 5 is a partial schematic top view of the printhead of FIG. 1 that shows the capacitive coupling between heating resistors and their associated tantalum protective regions.

Referring now to FIGS. 3 and 5, in accordance with the invention, tantalum regions 56 are interconnected by means of an aluminum bus 58, and are connected to the grounded sensor contact 27 by means of conductive ink 57. Bus 58 extends in the space between tantalum regions 56 and front face 36 of printhead 10. Bus 58 terminates at either end in terminals 40. At terminals 40, bus 58 connects to an external bias supply 59 that provides bus 58, and hence tantalum regions 56, with a positive bias with respect to ink 57. Connecting opposite ends of bus 58 to bias supply 59 reduces the voltage drop across along the length of bus 58 caused by parasitic resistance. Of course, external bias supply 59 could be replaced with a power supply provided internal to printhead 10, such as a battery or a regulated power supply.

Referring now to FIGS. 1, 3 and 5, both power bus 38 and bus 58 are constructed in the relatively narrow space between heating resistors 24 and front face 36 of printhead 10. In the preferred embodiment, heater board 12 is constructed using a two metal process, with bus 58 constructed in the first metal layer and power bus 38 constructed in the second metal layer. While a two metal process is more complicated than a single metal process, it allows power bus 38 and bus 58 to be connected to heating resistors 24 and tantalum regions 56, respectively, without the need for higher resistance interconnects, such as doped polysilicon, to bridge over or under one or the other. Power bus 38 is constructed in the second metal layer because power bus 38 needs to handle more power than bus 58, and in a two metal process the second metal layer is thicker than the first metal layer, and hence more suitable to the power requirements of power bus 38.

In the preferred embodiment, a return path for the positive bias provided to tantalum regions 56 by bus 58 is provided by conductive ink 57 and the contact of ink 57 with grounded sensor contact 27. Alternatively, a return path could be provided by connecting tantalum regions 56 to common bus 46. The connection between tantalum regions 56 and common bus 46 could be made using conductive polysilicon interconnections.

Supplying tantalum regions 56 with the appropriate positive bias reduces hydrogen embrittlement of the tantalum in tantalum regions 56. The appropriate positive bias provides anodic protection by canceling, or at least reducing, the difference in work functions between the tanalum in tantalum regions 56 and the hydrogen ions present in ink 57.

For any given printhead 10, the proper bias should be determined by experiment. An upper limit on the magnitude of the positive bias is set by the bias at which electrolysis of the water occurs, which is one volt: For a positive bias of approximately 1 volt or greater, electrolysis of the water in the ink takes place, causing bubbles to form in the ink that degrade performance by absorbing energy that otherwise would be used to expel droplets 28. Thus, the proper bias determined by experiment is likely to be between 0 and 1 volt. Based on the difference in work functions between tantalum and the hydrogen ions, the appropriate positive bias should be about 0.5 volts.

Interconnecting tantalum regions 56 with a low resistance bus 58 reduces corrosion of the tantalum regions 56 caused by electrochemical reaction. Interconnecting the tantalum regions 56 with a low resistance bus 58 reduces capacitive coupling between an active heating resistor 24 and its tantalum region 56, thereby reducing the magnitude of voltage spikes that pass through the tantalum region 56 during the rise and fall of the heating pulse.

The reduction in capacitive coupling can be shown with reference to FIGS. 3 and 5. Like FIG. 4, FIG. 5 is a partial schematic top view of printhead 10. In addition, the FIG. 5 schematic diagram models the capacitive coupling between a heating resistor 24 and its tantalum region 56. In the model, each tantalum region 56 is represented by a resistor 65. The capacitance between each tantalum region 56 and its respective heating resistor 24 is represented by a capacitor 63. Opposite ends of each capacitor 63 are connected to the midpoints of its associated heating resistor 24 and resistor 65, an arrangement that reflects the parasitic nature of the capacitive coupling between a heating resistor 24 and its respective tantalum region 56. One end of each resistor 65 is connected to bus 58. The other end of each resistor 65 is connected to ground (i.e., grounded sensor contact 27) through a resistor 67. Resistors 67 provide a simplified representation of the resistance that ink 57 provides between each tantalum region 56 and grounded sensor contact 27.

Using the model of FIG. 5, the time constant for a single active heating resistor 24 can be calculated. The time constant is calculated as the product of resistances and capacitances in the path connecting active heating resistor 24 to ground through its respective tantalum region 56. In this path the only capacitance is capacitor 63, but a few resistances need to be taken into account. Calculating the resistance of the path is simplified by recognizing that bus 58 is an AC ground. For simplicity, bus 58 is assumed to be at a DC ground level as wel (a bias of 0 volts). With bus 58 at ground, the RC time constant path contains a part of the active heating resistor 24 in series with the parallel combination of ink resistor 67 and a part of tantalum region resistor 65. Typical resistances of ink resistor 67 and tantalum region resistor 65 are 10,000 ohms and 15 ohms, respectively. (The value for resistor 65 is derived from the area of each tantalum region 56, 5 squares, and the sheet resistance of the tantalum, 3 ohms per square.) Given these relative resistances, the parallel combination can be approximated as the resistance of part of resistor 65, or simply the resistance of resistor 65. The resistance component of the RC time constant is then the sum of the resistance of resistor 65 and a portion of the resistance of heating resistor 24, or approximately the sum of the resistances of resistors 24 and 65, or about 200 ohms. The measured capacitance of capacitor 65 is about 3 picofarads. The resulting time constant is 0.6 nanoseconds, much less than the measured minimum rise time of 10 nanoseconds. In contrast, for a similar prior art system lacking bus 58, the time constant would be approximately the product of the capacitance of capacitor 63 with the sum of the resistances of resistor 67 and active heating resistor 24, or about 30 nanoseconds.

In calculating time constants, it is important to realize that often up to four adjacent heating resistors 24 are switched on as a group. These four active heating resistors 24 possess a group RC time constant that is approximately four times greater than the time constant of a single active heating resistor 24. The factor of four reflects the parallel combination of four capacitors 63;

four resistors 67 are not combined in parallel, despite the model of FIG. 5, since such a combination does not accurately describe the resistance of ink 57 for the case of four active, adjacent heating resistors 24.

The model of FIG. 5 presents a simplified view of printhead 10 that is adequate for demonstrating the effects of capacitive coupling, and showing how the effects are reduced by bus 58. Of course, the model has certain limitations (e.g., modeling ink 57 as a series of resistors 67 works well for analyzing a single active heating resistor 24, but not for analyzing multiple active heating resistors 24). Moreover, the model assumes that bus 58 has negligible resistance, and that the only capacitive component that need be considered is the capacitance between a heating resistor 24 and its associated tantalum region 56. From measurements and calculations, the latter assumption is correct. Whether the resistance of bus 58 is negligible, however, depends on the material from which bus 58 is constructed. Preferably, bus 58 is made of aluminum, a material that typically has a sheet resistance of 0.03 ohms per square. The resistance of an aluminum bus 58 is negligible compared to the resistances of ink 57 or tantalum regions 56. However, were bus 58 to be made of other materials commonly used to make connections for integrated circuits, the resistance of bus 58 may be a factor. For example, the resistance of bus 58 would be a factor were it made from either tantalum or conductive polysilicon, which have typical sheet resistances of 3 and 20 ohms per square, respectively.

The above analysis does not take into account a benefit of bus 58 connecting the tantalum regions 56 associated with active heating resistors 24 to tantalum regions 56 associated with inactive heating resistors 24. As mentioned previously, typically only four adjacent heating resistors 24 of an array of 200 or more heating resistors 24 are active at any one time. The voltage swings on the tantalum regions 56 associated with active heating resistors 24 are reduced by a capacitive voltage divider action provided by the connected, inactive, tantalum regions 56 and their associated heating resistors 24.

Details of the construction of printhead 10 can be shown with reference to FIGS. 1, 3 and 4. Heater board 12 includes a silicon substrate 48 with a major surface 49 on which there is patterned NMOS drive transistors 32 and logic control section 34. Of course, drive transistors 32 and logic control section 34 could be fabricate using technology other than NMOS. Major surface 49, drive transistors 32 and logic control section 34 are covered by passivation layer 50, which consists of a 1 micrometer thick layer of silicon dioxide. Glass mesas 52 are formed on passivation layer 50 where heating resistors 24 are to be subsequently placed. Glass mesas 52 consist of 0.9 micrometers thick thermally grown silicon dioxide formed in the same step in which field oxide regions (not shown) are formed. Heating resistors 24 consist of a 0.5 micrometer thick layer of polysilicon that is deposited on passivation layer 50, then patterned and etched, then patterned and doped with n+impurities in a quantity sufficient to provide the requisite sheet resistance for an overall resistance of 200 ohms. Heating resistors 24 are generally positioned above glass mesas 52, except for their opposite ends 25 and 27 that contact interconnects 42 and 41, respectively. In this manner, as discussed in U.S. Pat. No. 4,935,752 to Hawkins, the ends 25 and 27 remain cooler than the remainder of heating resistors 24, decreasing the failure of the connections at ends 25 and increasing the transfer of heat from heating resistors 24 to the ink 57.

Dielectric regions 54 are then formed on top of heating resistors 24. Dielectric regions 54 can be constructed from silicon dioxide thermally grown from the polysilicon that forms heating resistors 24, or from deposited silicon nitride, or from the silicon dioxide followed by the silicon nitride. Protective regions 56 are formed from a 1 micrometer thick layer of tantalum deposited on dielectric regions 54 over heating resistors 24. The tantalum layer is etched off, except over the portion of heating resistors 24 that reside over glass mesas 52. Dielectric regions 54 are etched off the opposing ends 25 and 27 of heating resistors 24 for the attachment of interconnects 42 and 41. A first aluminum metal layer is deposited, patterned and etched to form bus 58 and interconnects 41 and 42. A passivation layer 51 is deposited then etched to uncover portions of protective regions 56, and to uncover interconnects 41 for the attachment of power bus 38. Passivation layer 51 consists of a 1 micrometer thick layer of deposited silicon dioxide. The second aluminum metal layer is deposited, patterned and etched to form power bus 38 and common bus 46. For lead passivation, a final passivation layer 61, consisting of 1 micrometer thick silicon dioxide, is deposited, patterned and etched to uncover terminals 42 and a portion of protective regions 56 to be exposed to ink 57 in channels 20.

In recapitulation, the present invention relates to an improved thermal ink jet printhead 10 supplied with a bias voltage and having at least one ink channel 20, a heating element 24, and an interconnect 42. The ink channel 20 has an open end that serves as a nozzle, and the heating element 24 is positioned in the channel 20 for ejecting ink droplets 28 from the nozzle by selective application of current pulses along the interconnect 42 to the heating element 24. Printhead 10 further includes a conductive protective region 56 that is positioned adjacent the heating element 24 and that has a portion thereof exposed to the ink channel 20 for protecting the heating element 24 from ink 57. Protective region 56 is insulated from heating element 24 by dielectric region 54. Printhead 10 also includes means for connecting the bias voltage to protective region 56, such as bus 58, and means for providing a return path for the bias voltage, such as conductive ink 57 and grounded sensor contact 27 contacting ink 57. Preferably, protective region 56 includes a layer of tantalum, and bus 58 is made of aluminum.

Many modifications and variations are apparent from the foregoing description of the invention and all such modifications and variations are intended to be within the scope of the present invention.

I claim:

1. In an ink jet printhead having at least one ink channel, a heating element, and an interconnect, the ink channel having an open end that serves as a nozzle, the heating element being positioned in the ink channel for ejecting ink droplets from the nozzle by selective application of current pulses along the interconnect to the heating element, said printhead further comprising:

ink contained within the ink channels;

a conductive protective region positioned adjacent the heating element and having a portion thereof exposed to the ink channel for protecting the heating element from said ink;

a dielectric region positioned between the heating element and said conductive protective region for electrically insulating the heating element from said conductive protective region;

a bias voltage having a magnitude equal to or less than the difference in work functions of the conductive protective region and the ink; and means for connecting said bias voltage to said conductive protective region so that said conductive protective region is provided with anodic protection.

2. The thermal ink jet printhead of claim 1, wherein said conductive protective region includes tantalum, and said bias voltage has a magnitude of less than 1 volt.

3. A thermal ink jet printhead supplied with a bias voltage sufficient to provide anodic protection and having an ink channel structure with a plurality of nozzles at one end, an ink manifold at another end, and a plurality of ink channels with an ink channel connecting each nozzle to the ink manifold, the ink channel structure fixedly adjoined to a circuit board which contains driver logic and heating elements formed on a surface of a common substrate, the heating elements being positioned in the channels for ejecting ink droplets from the nozzles, said printhead further comprising:

a conductive protective region positioned adjacent each of the heating elements and having a portion thereof exposed to the ink channel for protecting the heating element from ink;

a dielectric region positioned between each of the heating elements and their respective conductive protective regions for electrically insulating each of the heating elements from their respective conductive protective regions; and means for connecting the bias voltage to said conductive protective regions so that said conductive protective regions are provided with anodic protection, said bias voltage connecting means further including a conductive interconnect, made of aluminum, for connecting the bias voltage to said conductive protective regions, said conductive interconnect being the bottom metal level of a double metal process.

4. A thermal ink jet printer having a printhead having a plurality of nozzles at one end, an ink manifold at another end, and a plurality of ink channels with an ink channel connecting each nozzle to the ink manifold, and heating elements being positioned in the ink channels for ejecting ink droplets from the nozzles upon selected application of current pulses to the heating elements, the printer further comprising:

conductive, grounded ink contained in the ink manifold and ink channels;

means for supplying a bias voltage sufficient to provide anodic protection;

a conductive protective region positioned adjacent each heating element and having a portion thereof exposed to the ink channel for protecting the heating element from ink;

a dielectric region positioned between each of the heating elements and their respective conductive protective regions for electrically insulating each of the heating elements from their respective conductive protective regions; and means for connecting said bias voltage supply means to said conductive protective regions, said bias voltage supply connecting means including a conductive path through said ink to ground.

5. A thermal ink jet printer having a printhead having a plurality of nozzles at one end, an ink manifold at another end, and a plurality of ink channels with an ink channel connecting each nozzle to the ink manifold, and heating elements being positioned in the ink channels for ejecting ink droplets from the nozzles upon selected application of current pulses to the heating elements, the printer further comprising:

means for supplying a bias voltage sufficient to provide anodic protection;

a conductive protective region positioned adjacent each heating element and having a portion thereof exposed to the ink channel for protecting the heating element from ink;

a dielectric region positioned between each of the heating elements and their respective conductive protective regions for electrically insulating each of the heating elements from their respective conductive protective regions; and means for connecting said bias voltage supply means to said conductive protective regions, wherein the heating elements, said conductive protective regions, and said bias voltage supply connecting means as a group are constructed such that the group RC time constant is less than the rise time of a current pulse sent to the heating elements.

6. A thermal ink jet printer having a printhead having a plurality of nozzles at one end, an ink manifold at another end, and a plurality of ink channels with an ink channel connecting each nozzle to the ink manifold, and heating elements being positioned in the ink channels for ejecting ink droplets from the nozzles upon selected application of current pulses to the heating elements, the printer further comprising:

conductive ink positioned in the ink channels;

means for supplying a bias voltage sufficient to provide anodic protection;

a conductive protective region positioned adjacent each heating element and having a portion thereof exposed to the ink channel for protecting the heating element from ink;

a dielectric region positioned between each of the heating elements and their respective conductive protective regions for electrically insulating each of the heating elements from their respective conductive protective regions; and means for connecting said bias voltage supply means to said conductive protective regions, wherein said bias voltage supply means provides said conductive protective region with a positive bias voltage of between approximately 0 volts and 1 volt with respect to said conductive ink.

7. The thermal ink jet printer of claim 6, wherein said bias voltage supply means supplies said conductive protective region with a bias voltage of approximately 0.5 volts with respect to said conductive ink.

* * * * *